US007488281B2

(12) United States Patent
Weir et al.

(10) Patent No.: US 7,488,281 B2
(45) **Date of Patent: *Feb. 10, 2009**

(54) ABDOMINAL MUSCLE TRAINING APPARATUS

(75) Inventors: Ross John Weir, Loughborough (GB); Michael Peter Caine, Cropston (GB)

(73) Assignee: Progressive Sports Technologies Limited (GB)

( * ) Notice: Subject to any disclaimer, the term of this patent is extended or adjusted under 35 U.S.C. 154(b) by 10 days.

This patent is subject to a terminal disclaimer.

(21) Appl. No.: 11/652,322

(22) Filed: Jan. 11, 2007

(65) Prior Publication Data

US 2008/0096743 A1 Apr. 24, 2008

(30) Foreign Application Priority Data

Oct. 4, 2006 (GB) ..... 0619515.0

(51) Int. Cl.
*A63B 26/00* (2006.01)

(52) U.S. Cl. ..... 482/140; 482/142

(58) Field of Classification Search ..... 482/140, 482/907, 91, 123, 129–130, 121
See application file for complete search history.

(56) References Cited

U.S. PATENT DOCUMENTS

2008/0004166 A1* 1/2008 Oren et al. ..... 482/142

* cited by examiner

*Primary Examiner*—Lori Amerson
(74) *Attorney, Agent, or Firm*—Renner, Kenner, Greive, Bobak, Taylor & Weber

(57) ABSTRACT

Exercise apparatus (10) for training a user's abdominal muscles comprises a lever frame (11) linked to a support frame (12) at a pivot (13). The lever frame (11) has first and second arms (14,15) joined at a junction (16) also forming a fulcrum for the lever frame (11). The support frame (12) consists of a base member (22) having a seat portion (23) associated with, and laterally rotatable relative to, the base member (22). The apparatus (10) may be used to perform either simple or compound abdominal muscles training exercises. In a simple exercise, the user∝s abdominal muscles are exercised by pushing the first arm (14) away from the user's body to rotate the lever frame (11) about its fulcrum (16), causing the seat portion (23) associated with the base member (22) to lift and tilt. In a compound exercise, the user's obliques and transversus abdominal muscles are exercised by performing an abdominal twisting motion to cause the seat portion (23) to rotate relative to the base member (22).

20 Claims, 2 Drawing Sheets

ABDOMINAL MUSCLE TRAINING APPARATUS

TECHNICAL FIELD

This invention relates to improved exercise apparatus for training a user's abdominal muscles. In particular, it relates to such apparatus in which the user exercises in a supported half-kneeling position, promoting neutral pelvic alignment, and which enables the user to exercise the obliques and transversus abdominal muscle groups.

BACKGROUND OF THE INVENTION

During physical exercise, the body is subjected to stresses and strains beyond those normally encountered in everyday activities. These stresses and strains increase the risk of injury to areas of the body such as the joints, and care should be taken to minimise such risks wherever possible during training. In the performance of exercises for training the abdominal muscles, the joint between the pelvis and the spine is particularly at risk. To minimise the risk of injury to this joint, it is beneficial to maintain the pelvis in a position substantially at the mid-point of its range of anterior to posterior rotation about the joint. This position is referred to herein as neutral pelvic alignment.

The ideal body position for maintaining neutral pelvic alignment is referred to herein as the half-kneeling position. This involves the user being supported by his or her knees and buttocks only, with a somewhat larger angle being formed between the abdomen and the upper legs than is customary in a normal seated position.

Conventional fitness apparatus for training a user's abdominal muscles tends not to operate with the user in positions which promote neutral pelvic alignment. Additionally, many known abdominal training devices rely solely on weight-stacks or elastic resistance elements to provide the resistive force which the user must overcome during exercise. The use of weight-stacks makes the product difficult and expensive to ship, and cumbersome to move once installed, whilst the use of elastic resistance elements alone results in the resistive load increasing exponentially as the material is stretched. Unless used in combination with other resistive loads, this provides an unnatural load and decreases the specificity of the exercise, i.e. the targeting of a particular exercise to a particular group of muscles.

Exercise apparatus enabling a user to perform abdominal muscle training exercise from a half-kneeling position so as to promote neutral pelvic alignment is described in the applicant's co-pending International Patent Application No. PCT/GB2006/050263. The exercise apparatus described therein comprises a lever frame linked to a support frame at a pivot. The lever frame has first and second arms joined at a central junction also forming a fulcrum. The support frame has a base member with a seat portion. The apparatus is operated by the user pushing the first arm away from his or her body causing the lever frame to rotate about its fulcrum. This lifts the second arm, which in turn causes the seat portion to lift and/or tilt.

The user's abdominal muscles are thus exercised in lifting his or her body mass, thus ensuring a more natural load than when working only against applied loads from weight stacks and resistance elements. The apparatus described in PCT/GB2006/050263 is also capable of being adapted for use as a static kneel chair, in which the user may easily and safely mount and dismount from the rear of the seat.

SUMMARY OF THE INVENTION

The present invention seeks to improve upon the exercise apparatus described in PCT/GB2006/050263 by adding a twisting functionality to the apparatus so as to enable a user also to exercise his or her obliques and/or transversus abdominal muscle groups.

Therefore, according to the present invention there is provided exercise apparatus comprising:

a support frame having a base member and a seat portion associated with said base member and laterally rotatable relative thereto, said seat portion being adapted to support a user in a half-kneeling position; and a lever frame having a first arm adapted for manual operation by said user, and a second arm linked to the base member, said first and second arms being joined at a junction at or adjacent a fulcrum for the lever frame;

whereby in use, the exercise apparatus is operable by said user performing at least one of the following exercises:

(i) a simple abdominal muscle exercise comprising pushing said first arm away from his or her body to rotate the lever frame about its fulcrum, causing the seat portion associated with the base member to lift and/or tilt, so as to exercise the user's abdominal muscles;

and/or:

(ii) a compound abdominal muscle exercise comprising causing the seat portion to rotate relative to the base member by an abdominal twisting motion, thereby to exercise the user's obliques and transversus abdominal muscle groups.

In a currently preferred embodiment of the present invention, the first and second arms of the lever frame are arranged generally perpendicular to one another thereby to form a generally L-shaped lever frame. The lever frame thus has a handle end, adapted for manual operation, and a free end, with the junction being located therebetween. The junction between the first and second arms is preferably rounded and arranged to bear against a working surface beneath the exercise apparatus.

The rounded junction may be arranged to bear directly against the working surface, or in alternative embodiments of the present invention may be arranged to bear against the working surface via an intermediary member. Suitable constructions of intermediary member include the use of a rocker bar arranged perpendicularly across the lever frame and optionally having rounded feet at either end thereof adapted to bear against the working surface. The forces imparted by the user during exercise are thus displaced to either side of the apparatus, giving enhanced stability.

The simple abdominal muscle exercise (i) as hereinbefore described is performable by the user repeating a cycle of pushing the first arm away from his or her body, and subsequently releasing the manual force applied to the first arm. As the manual force is released, the user's body mass urges the seat portion back to its initial rest position, which in turn causes the lever frame to return to its rest position. The lever frame thus rotates about the fulcrum in a back-and-forth rocking motion as the manual force is repeatedly applied and released. To provide comfort to the user, and to enable the performance of a range of different exercises, the first arm preferably comprises a handlebar adapted for manual operation by the user.

The second arm of the lever frame is preferably linked to the support frame base member via a pivot. Operation of the lever frame causes the second arm and the pivot to lift away from the working surface, causing the seat portion both to lift and to tilt. This action ensures that both the user's upper and lower abdominal muscles are exercised in lifting his or her body mass, thus promoting the execution of a correct abdominal contraction. Counter-clockwise rotation of the lever frame about the fulcrum causes clockwise rotation of the support frame about the pivot, and vice versa.

The support frame base member extends from the pivot to a foot adapted to bear against the working surface beneath the exercise apparatus. The foot remains in contact with the working surface throughout the performance of exercise, and is adapted for translational movement along the working surface towards the lever frame fulcrum, when the pivot is lifted away from the working surface by the action of the lever frame. The foot therefore effectively acts as a further fulcrum for the support frame.

To facilitate the translational movement of the foot along the working surface, the foot is preferably provided with a rotational member. Most preferably, the rotational member comprises one or more wheel(s) or roller(s).

In a currently preferred construction of exercise apparatus according to the present invention, the seat portion is joined to the base member at a connection point located at or adjacent the pivot, preferably by means of a seat post extending between the base member and the seat portion.

In order to facilitate the lateral rotational motion of the seat portion relative to the base member, as required for the performance of the compound abdominal muscle exercise (ii) as hereinbefore described, the seat post preferably comprises a lower section formed integrally with the base member and an upper section carrying the seat portion. The upper section is then mounted on the lower section for lateral rotational movement relative thereto.

The upper section is preferably mounted on the lower section in such a manner as to allow the user, by performing abdominal twisting motions and/or by shifting his or her body mass, to cause the seat portion to rotate alternately to either side of the exercise apparatus.

The twisting motion required in order to cause the seat portion to rotate will itself result in the user performing work and thus exercising his or her obliques and transversus abdominal muscle groups. However, it is highly desirable that the exercise be performed against an applied resistive force, which may conveniently be imparted by a resistance element housed within the seat post.

The seat post therefore preferably comprises a resistance element adapted to provide resistance to the rotational motion of the upper section relative to the lower section, such that in use the user is required to perform work to overcome said resistance, thereby exercising his or her obliques and/or transversus abdominal muscle groups. Most preferably, the seat post resistance element is a rubber torsion bush.

Additionally, elastic resistance elements may be utilised to link the free end of the lever frame with the foot end of the support frame. In such embodiments, the foot end of the support frame is preferably provided with one or more fixing points, whilst the elastic resistance elements are preferably adapted to extend from the free end of the lever frame and are provided with complementary engagement means to connect to said fixing points.

In order to support the user in the half-kneeling position, and thereby promote neutral pelvic alignment, the seat portion comprises a buttock support element and a knee rest element. The knee rest element may be formed either as a single unit extending across the support frame and adapted to accommodate both knees, or alternatively may take the form of two separate units, displaced slightly to the sides of the support frame, each adapted to accommodate one knee.

The pivot between the lever frame and the support frame preferably comprises a lockable pin engageable with a complementary aperture formed in each of the second arm of the lever frame and the base member of the support frame. Most preferably, the second arm of the lever frame and the base member of the support frame each comprise a plurality of spaced like apertures, to enable the location of the pivot to be adjusted. The resistance provided by the user's body mass, and hence the work required to overcome that resistance, can thus be adjusted by changing the location of the pivot.

The construction of exercise apparatus according to the present invention is not limited to any particular form, however it is preferred that at least one of the lever frame and the support frame are formed with a parallel tubular construction. In embodiments where the use of elastic resistance elements linking the foot end of the support frame with the free end of the lever frame is combined with the tubular construction of the lever frame, the elastic resistance elements may conveniently be recoiled within the tubular lever frame for storage when not in use.

The support frame is preferably detachable from the lever frame thereby to form a static kneel chair. One or both of the thus-disassembled frames is preferably further foldable to facilitate storage of said exercise apparatus when not in use.

BRIEF DESCRIPTION OF THE SEVERAL VIEWS OF THE DRAWINGS

In order that the present invention may be fully understood, a preferred embodiment thereof will now be described in detail, though only by way of example, with reference to the accompanying drawings in which.

DETAILED DESCRIPTION OF THE INVENTION

Figure 1:
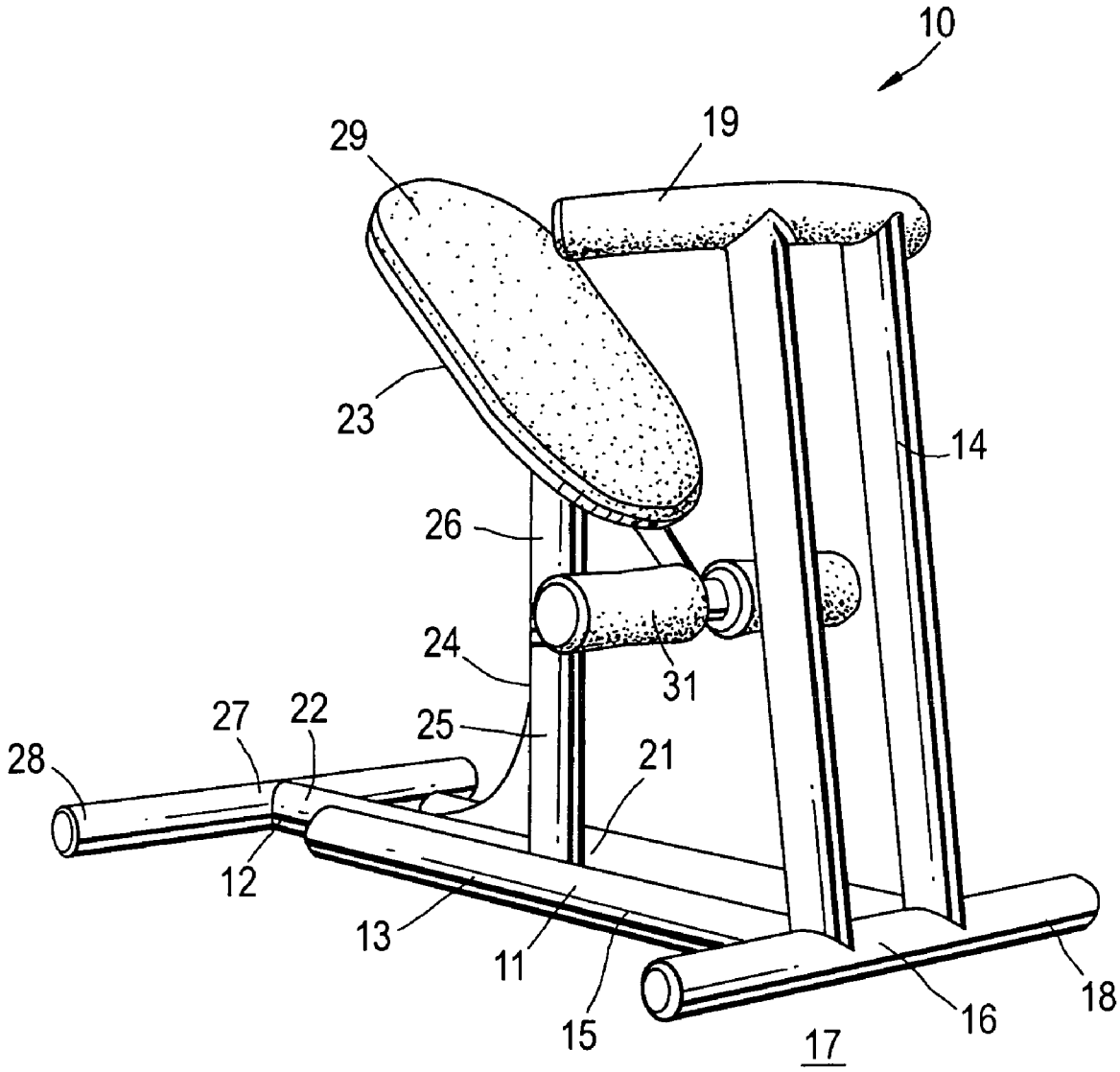
FIG. 1 is a perspective view of exercise apparatus according to a preferred embodiment of the present invention.

Referring first to FIG. 1, there is shown a preferred embodiment of exercise apparatus, generally indicated 10, according to the present invention. The exercise apparatus 10 comprises a lever frame 11 and a support frame 12 linked via a pivot, generally indicated 13.

The lever frame 11 is generally L-shaped, having first and second arms 14, 15 joined at a rounded central junction 16 which forms a fulcrum for the lever frame 11 by bearing against a working surface 17 beneath the exercise apparatus 10 via a rocker bar 18. The first arm 14 terminates at a handlebar 19, whilst the second arm 15 is provided with an aperture 21 for receiving a pivot pin (not shown).

The support frame 12 has a base member 22 with a seat portion 23 joined thereto by a seat post 24. The seat post 24 comprises a lower section 25 formed integrally with the base member 22, and an upper section 26 carrying the seat portion 23. The upper section 26 is mounted on the lower section 25 for lateral rotational movement relative thereto, as will be described in more detail below with reference to FIG. 3.

The base member 22 is provided with a further aperture 21, and terminates in a foot 27 which is provided with a roller 28 to facilitate translational movement.

The seat portion 23 comprises a buttock rest element 29 and a pair of knee rest elements 31, one to each side of the support frame 12. The relatively thin shape of the support frame 12 and the seat portion 23 allows a user (not shown)

easily to mount and dismount from the back of the seat portion 23, with his or her knees sliding past the buttock rest element 29 and onto the knee rest elements 31.

As can be seen from FIG. 1, the lever frame 11 is formed as a pair of cross-linked parallel tubular members, whilst the support frame 12 is formed with a single tubular construction. This facilitates the required relative spatial arrangement of the lever frame 11 and the support frame 12, as the support frame base member 22 can be inserted between the parallel tubular members of the second arm 15 of the lever frame 11.

Figure 2:
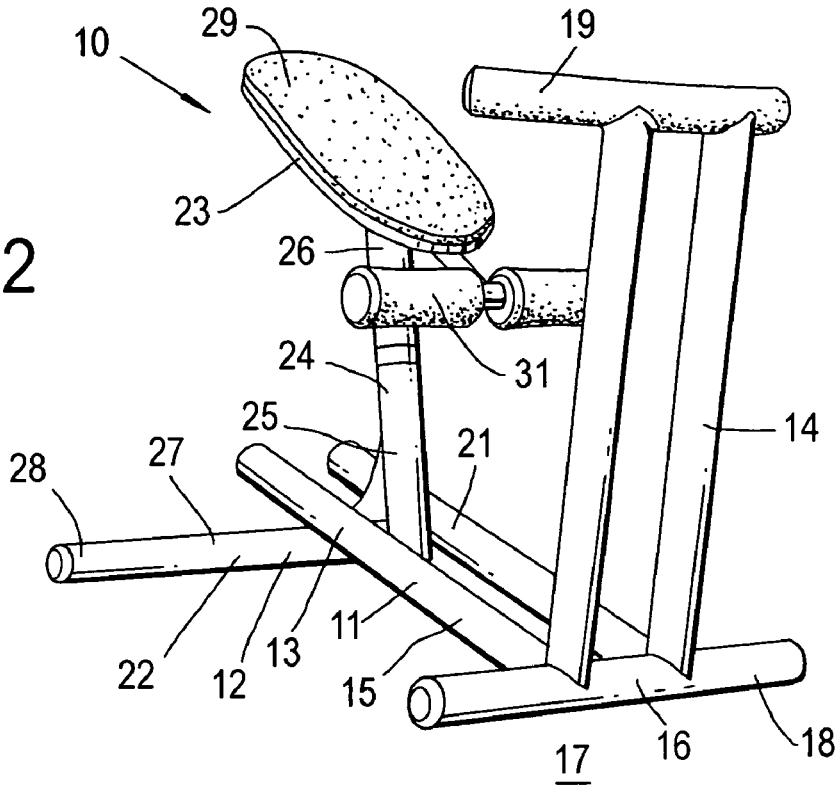
FIG. 2 is a perspective view of the exercise apparatus of FIG. 1, in use during the performance of a simple abdominal muscle exercise (i)

Referring now to FIG. 2, there is shown an illustration of the relative positions of the lever frame 11 and the support frame 12 as the exercise apparatus 10 is operated during a simple abdominal muscle training exercise (i). Starting from the rest position as shown in FIG. 1, operation of the exercise apparatus 10 begins with a user (not shown) supported on the seat portion 23 pushing the first arm 14 away from his or her body using the handlebar 19. This causes the lever frame 11 to rotate in a counter-clockwise direction on its rounded central junction 16, which acts as a fulcrum by bearing against the working surface 17 beneath the exercise apparatus 10, via the rocker bar 18. The rotation of the lever frame 11 lifts the second arm 15, causing the pivot 13 to be displaced vertically upwards.

Due to the pivotal connection of the lever frame 11 to the support frame 12 at the pivot 13, the support frame 12 is then caused to rotate in a clockwise direction. The lifting and tilting motion of the support frame 12 is assisted by the translational movement of the foot roller 27, 28 along the working surface 17 towards the fulcrum 16.

As the exercise apparatus 10 reaches the limit of its dynamic range by virtue of the motion of the lever frame 11 and the support frame 12, the pivot 13 is lifted clear of the working surface 17 by the scissor-like action of the second arm 15 of the lever frame 11 with the support frame base member 22. The seat portion 23 is both lifted and tilted backwards closer to the horizontal, whilst the first arm 14 of the lever frame 11 is further from the seat portion 23 than in the rest position shown in FIG. 1.

The user returns the exercise apparatus 10 to its rest position by releasing the manual force applied to the first arm 14 of the lever frame 11. As the force is released, the user's body mass urges the support frame 12 back to its rest position by rotating it in a counter-clockwise direction, and lowering the pivot 13 back towards the working surface 17. The motion of the support frame 12 is assisted by the translational motion of the foot roller 27, 28 along the working surface 17 away from the fulcrum 16. As the pivot 13 is lowered, the second arm 15 of the lever frame 11 is also lowered back towards the working surface 17, causing the lever frame 11 to rock back on its fulcrum 16 in a clockwise direction, which in turn brings the handlebar 19 back to its rest position.

The motion of the lever frame 11 and the support frame 12 returns the exercise apparatus 10 to its rest position ready for the start of the next sequence. The sequence will typically be repeated many times during the performance of the simple abdominal muscle training exercise (i), in an alternate back-and-forth rocking motion.

Figure 3:
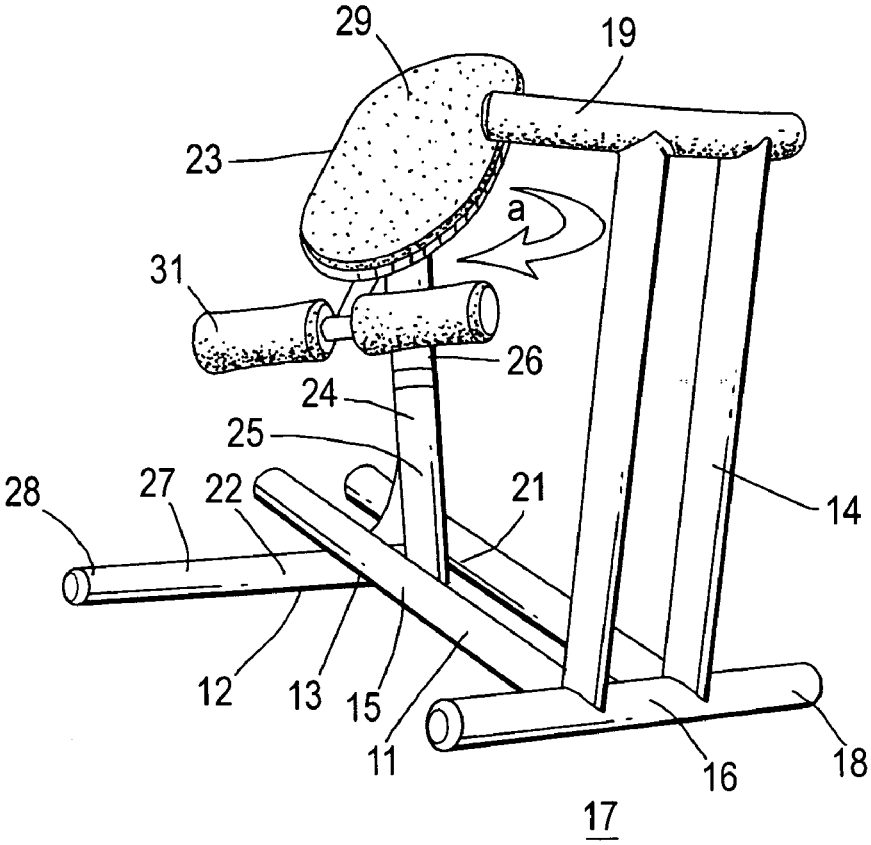
FIG. 3 is a perspective view of the exercise apparatus of FIGS. 1 and 2, in use during the performance of a compound abdominal muscle exercise (ii).

Referring now to FIG. 3, there is shown an illustration of the relative positions of the lever frame 11, the support frame 12 and the seat portion 23 as the exercise apparatus 10 is operated during a compound abdominal muscle training exercise (ii), performed simultaneously with the simple abdominal muscle training exercise (i) described above with reference to FIG. 2. It should be understood however that the compound abdominal muscle training exercise (ii) may be performed independently of the simple abdominal muscle training exercise (i), as well as simultaneously therewith as shown in FIG. 3.

To perform the compound abdominal muscle training exercise (ii), the user (not shown) grasps the handlebar 19 and performs an abdominal twisting motion, shifting his or her body mass to one side. This causes the upper section 26 of the seat post 24 to rotate laterally relative to the lower section 25 so that the entire seat portion 23 is rotated to one side of the exercise apparatus 10, as indicated by arrow a.

The lateral rotational motion of the seat portion 23 relative to the base member 22 is resisted by a rubber torsion bush (not visible) inside the seat post 24. The torsion bush provides resistance to the lateral rotational motion of the upper section 26 of the seat post 24, which carries the seat portion 23, relative to the lower section 25, which is formed integrally with the base member 22. In order to execute the lateral rotation of the seat portion 23, the user is therefore required to perform work to overcome the resistance imparted by the torsion bush, thus exercising his or her obliques and transversus abdominal muscle groups.

Having executed a lateral rotation of the seat portion 23 to one side of the exercise apparatus 10, the user then performs a reverse abdominal twisting motion, shifting his or her body mass in the opposite direction. The seat portion 23 is thus rotated out to the other side of the exercise apparatus. This sequence will typically be repeated many times during the performance of the compound abdominal muscle training exercise (ii), in an alternate side-to-side twisting motion.

The invention claimed is:

1. Exercise apparatus comprising:

a support frame having a base member;

a seat portion associated with said base member and laterally rotatable relative thereto, said seat portion comprising a buttock support element and a knee rest element and being thereby adapted to support a user in a half-kneeling position; and a lever frame having a first arm adapted for manual operation by said user, and a second arm linked to the base member, said first and second arms being joined at a junction at or adjacent a fulcrum for the lever frame;

said exercise apparatus being operable by said user performing at least one of the following exercises:

(i) a simple abdominal muscle training exercise comprising pushing said first arm away from said user's body to rotate the lever frame about said fulcrum, causing the seat portion associated with the base member to lift and tilt, so as to exercise the user's abdominal muscles;

and:

(ii) a compound abdominal muscle training exercise comprising causing the seat portion to rotate relative to the base member by an abdominal twisting motion, thereby to exercise the user's obliques and transversus abdominal muscle groups.

2. Exercise apparatus according to claim 1, wherein:

said first and second arms are arranged generally perpendicular to one another thereby to form a generally L-shaped lever frame;

said second arm terminates at a free end; and the junction of said first and second arms is rounded and arranged to bear against a working surface beneath the exercise apparatus;

and wherein said simple abdominal muscle exercise (i) is performable by said user repeating a cycle of applying a manual force to the first arm so as to push said first arm away from said user's body, and subsequently releasing said applied force, thereby to rotate the lever frame about said fulcrum in a back-and-forth rocking motion.

3. Exercise apparatus according to claim 2, wherein the junction forms a fulcrum for the lever frame and is arranged to bear directly against the working surface.

4. Exercise apparatus according to claim 2, wherein the junction is arranged to bear indirectly against the working surface via an intermediary member forming a fulcrum for the lever frame.

5. Exercise apparatus according to claim 4, wherein the intermediary member is a rocker bar having rounded feet at either end thereof.

6. Exercise apparatus according to claim 2, wherein the lever frame is linked to the support frame via a pivot, such that counter-clockwise rotation of the lever frame about the fulcrum causes clockwise rotation of the support frame about the pivot, and vice versa.

7. Exercise apparatus according to claim 6, wherein the base member extends from the pivot to a foot adapted to bear against a working surface beneath the exercise apparatus, said foot being adapted for translational movement along said working surface.

8. Exercise apparatus according to claim 7, wherein the foot is provided with a rotational member to facilitate said translational movement.

9. Exercise apparatus according to claim 8, wherein the rotational member comprises at least one wheel.

10. Exercise apparatus according to claim 6, wherein the seat portion is joined to the base member at a connection point located at or adjacent the pivot.

11. Exercise apparatus according to claim 10, wherein the seat portion is connected to the base member by a seat post comprising a lower section formed integrally with the base member and an upper section carrying the seat portion, and wherein said upper section is mounted on the lower section for rotational movement relative thereto.

12. Exercise apparatus according to claim 11, wherein the seat portion is adapted to be rotated alternately to each side of the exercise apparatus.

13. Exercise apparatus according to claim 11 wherein the seat post further comprises a resistance element adapted to provide resistance to the rotational motion of the upper section relative to the lower section, such that the user is required to perform work to overcome said resistance, thereby exercising said user's obliques and transversus abdominal muscle groups.

14. Exercise apparatus according to claim 13 wherein the seat post resistance element is a rubber torsion bush.

15. Exercise apparatus according to claim 7, wherein the free end of the lever frame and the foot of the support frame are linked by at least one elastic resistance element.

16. Exercise apparatus according to claim 15, wherein the foot of the support frame is provided with at least one fixing point adapted to receive said elastic resistance element, and wherein said elastic resistance element is provided with complementary engagement means adapted to connect to said fixing point.

17. Exercise apparatus according to claim 15, wherein the lever frame is formed with a hollow, tubular construction, and wherein said at least one elastic resistance element is adapted to extend from the free end of the lever frame when in use, but to be recoiled therewithin for storage when not in use.

18. Exercise apparatus according to claim 6, wherein each of the second arm of the lever frame and the base member of the support frame comprise a plurality of spaced like apertures, and wherein the pivot comprises a lockable pin engageable alternately with each of said apertures to enable the location of the pivot to be adjusted.

19. Exercise apparatus according to claim 1, wherein the seat portion comprises a buttock support element and two separate knee rest elements.

20. Exercise apparatus according to claim 1, wherein the first arm comprises a handlebar to facilitate manual operation by the user.

* * * * *